US012628920B2

(12) United States Patent
Brunette et al.

(10) Patent No.: US 12,628,920 B2
(45) Date of Patent: May 19, 2026

(54) WEARABLE PRODUCT AND DETACHABLE TAG ASSEMBLY

(71) Applicant: 4 Design Group, LLC, Longmont, CO (US)

(72) Inventors: Charles Shawn Brunette, Longmont, CO (US); Robert B. Davis, Englewood, CO (US); David J. Mahalek, Erie, CO (US); Theodore Prime Bertele, Longmont, CO (US); Lance Gregory Walton, Arvada, CO (US)

(73) Assignee: 4 Design Group, LLC, Longmont, CO (US)

( * ) Notice: Subject to any disclaimer, the term of this patent is extended or adjusted under 35 U.S.C. 154(b) by 181 days.

(21) Appl. No.: 18/263,333

(22) PCT Filed: Jan. 27, 2022

(86) PCT No.: PCT/US2022/014136
§ 371 (c)(1),
(2) Date: Jul. 27, 2023

(87) PCT Pub. No.: WO2022/165063
PCT Pub. Date: Aug. 4, 2022

(65) Prior Publication Data

US 2024/0315404 A1 Sep. 26, 2024

Related U.S. Application Data

(60) Provisional application No. 63/142,230, filed on Jan. 27, 2021.

(51) Int. Cl.

| | |
|---|---|
| ***A44C 5/00*** | (2006.01) |
| ***A44C 5/20*** | (2006.01) |
| ***A44C 17/02*** | (2006.01) |

(52) U.S. Cl.
CPC ..... *A44C 5/0015* (2013.01); *A44C 5/2071* (2013.01); *A44C 17/0208* (2013.01)

(58) Field of Classification Search
CPC ..... G09F 3/14; G09F 3/005; A63F 2250/609; A44C 5/0007; A44C 5/0053;
(Continued)

(56) References Cited

U.S. PATENT DOCUMENTS 2,653,402 A * 9/1953 Bonagura ..... G09F 7/16 63/3
3,559,854 A * 2/1971 Loveland ..... A44C 5/003 132/294

(Continued)

OTHER PUBLICATIONS

PCT Application No. PCT/US22/14136, International Search Report and Written Opinion, dated Apr. 12, 2022.

*Primary Examiner* — Cassandra Davis
(74) *Attorney, Agent, or Firm* — Timothy A. Hodgkiss; Buckingham, Doolittle & Burroughs, LLC

(57) ABSTRACT

A wearable product that can be customized according to a user's preferences includes a mounting track for receiving detachable tag assemblies representing a variety of interests, activities or organizations. The wearable product may be incorporated into a wide variety of items, including items that may be worn on a user's body, such as a wristband, hat, outerwear or other clothing, as well as items that would be carried by a user, such as a cell phone case, bag or laptop. The mounting track of a wearable product may be attached to an item using sewing thread, adhesive or hook and loop tape, for example. A mounting track may also form an integral part of the item. Tags may be used interchangeably between any item with a mounting track.

14 Claims, 10 Drawing Sheets

(58) Field of Classification Search
CPC ... A44C 5/0208; A44C 5/0216; A44C 5/0225; A44C 5/0015; A44C 5/2071; A44C 17/0208; G06F 1/163; H04M 1/0283; A44B 11/003; A44B 11/001
See application file for complete search history.

(56) References Cited

U.S. PATENT DOCUMENTS 4,912,944 A * 4/1990 Crosley ..... A44C 17/02 63/29.1
5,722,437 A * 3/1998 Chang ..... A45D 8/24 132/275
6,260,383 B1 * 7/2001 Warren ..... A44C 9/00 63/3
6,422,177 B1 7/2002 Noguero
6,688,316 B1 * 2/2004 Klug ..... A45D 8/002 211/13.1
8,998,484 B2 * 4/2015 Savoy ..... A44C 5/00 63/3
11,439,211 B2 * 9/2022 Barros ..... A44C 5/12
2003/0221449 A1 * 12/2003 DeShong ..... A44C 5/12 63/3
2005/0172669 A1 * 8/2005 Lacchetti ..... A44C 17/025 63/40
2008/0301853 A1 * 12/2008 Cummiskey ..... A44C 5/0053 2/170
2009/0145454 A1 * 6/2009 Saponaro ..... A45D 8/36 132/273
2009/0288239 A1 11/2009 Lee
2010/0269765 A1 10/2010 Barghahn
2012/0216374 A1 8/2012 Manuello
2015/0359304 A1 * 12/2015 Thomas ..... A44C 5/0053 63/3
2022/0232932 A1 * 7/2022 Johnston ..... A44C 5/12

* cited by examiner

WEARABLE PRODUCT AND DETACHABLE TAG ASSEMBLY

CROSS REFERENCE TO RELATED APPLICATIONS

This application claims priority to U.S. Provisional Application Ser. No. 63/142,230 filed Jan. 27, 2021, hereby incorporated by reference.

BACKGROUND

Wearable devices that allow the wearer to express support for sports teams, activities and interest have become increasingly popular. The locations in which a user may prefer to show this support include, for example, a wrist band, cell phone case, outerwear, hat, and clothing.

Many standalone items, such as tee-shirts, allow users to show support but they are not customizable. Other items that may be customized are restricted to a particular consumer good, such as a wristband. This restricts the ability of a user to express support for an organization or cause in a flexible way, whether for an event such as an alumni event, or because of changing preferences or activities.

SUMMARY

A wearable product includes a mounting track having a width W, a length L and a thickness T, the mounting track having an inner surface having width Wand length L; an outer surface having width Wand length L; a recessed tag channel integrally formed in the outer surface, the recessed channel having a width $W_1$<W and a thickness $T_1$<T; and a first attachment component in the recessed tag channel. The wearable product also includes a detachable tag assembly comprising a second attachment component that cooperates with the first attachment component to secure the detachable tag assembly in the recessed tag channel.

The first and second attachments components may have a variety of forms as long as they can be engaged and disengaged from each other. Aspects of the wearable product may include magnets, hook and loop tape, and adhesives.

DETAILED DESCRIPTION

Figure 1:
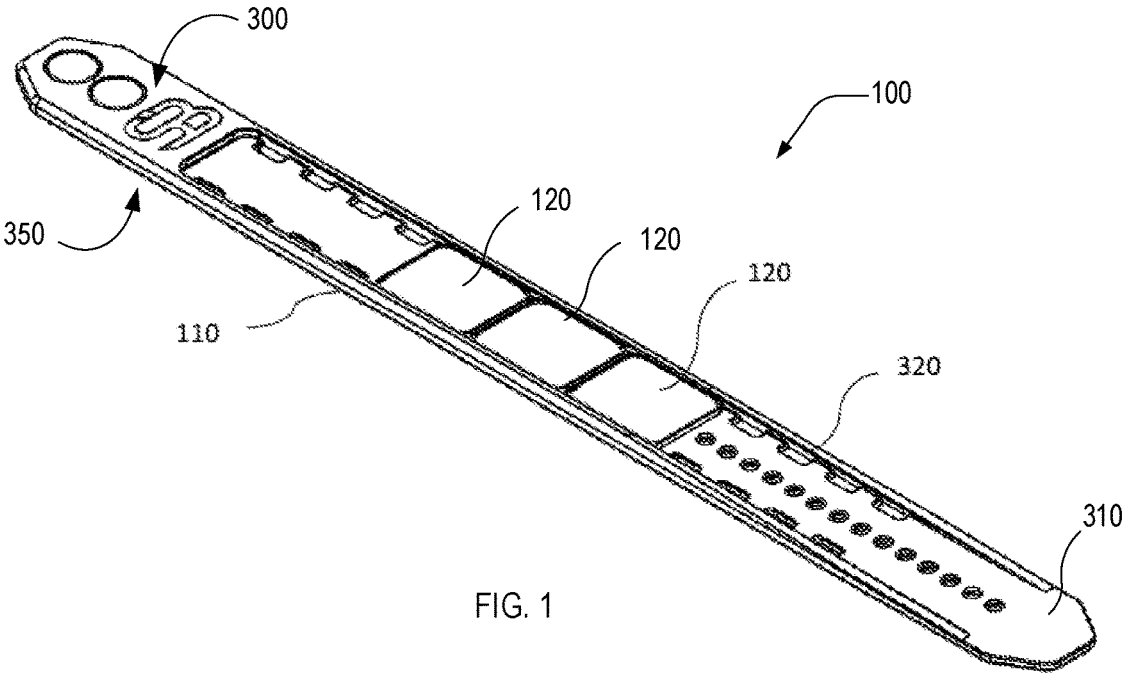
FIG. 1 is a perspective view of a wearable product with detachable tag assemblies, in embodiments.

A wearable product, such as a wristband, outerwear, hat, bag and clothing sew-in insert, utilizes a mounting track and detachable tag assembly to offer unique solutions for expressing support for all corresponding sports teams, activities and interest of the user. The mounting track as disclosed herein may take a variety of forms that can also be attached to other user products, such as a cellphone case or other electronic device. Although various embodiments are shown and described, these are to illustrate aspects of the mounting track and detachable tag assembly. The term "wearable product" will be used throughout to represent any combination of mounting track and detachable tag assembly, regardless of what device the mounting track is secured to or the manner of securing it. Any of the embodiments disclosed herein may be applied to any user product. Also, any of the embodiments of securing a detachable tag assembly may be used with any form of mounting track.

Embodiments comprise a customizable detachable tag assembly that is representative of the entity the user is supporting or the user's interests. For example, tag assemblies could represent professional sports such as F1, NFL, MLB, NHL, NBA; collegiate sports such as NCAA and NAIA; and amateur sports and activities such as the Olympics, high schools, charitable organizations, etc. Other interests and activities may also be represented. In embodiments, the detachable tag assembly may be inserted into a recessed tag channel on a mounting track, regardless of the configuration of the mounting track. This allows the wearable product to be customized with interchangeable detachable tag assemblies so tag assemblies can be added or removed as desired. The recessed tag channel for securing all detachable tag assemblies is the same regardless of the form and location of the mounting track.

Thus, the wearable product allows users to change accessories when the interests or circumstances of the user have changed or evolved. Further detachable tag assemblies may be moved between different wearable products depending on the activity of the user. Further, one wearable product, such as a purse or coat, may be customized with different detachable tags according to the activity of the user.

Various embodiments will now be discussed with reference to the figures, where like or similar elements are designated with identical reference numerals throughout the several views.

Figure 2:
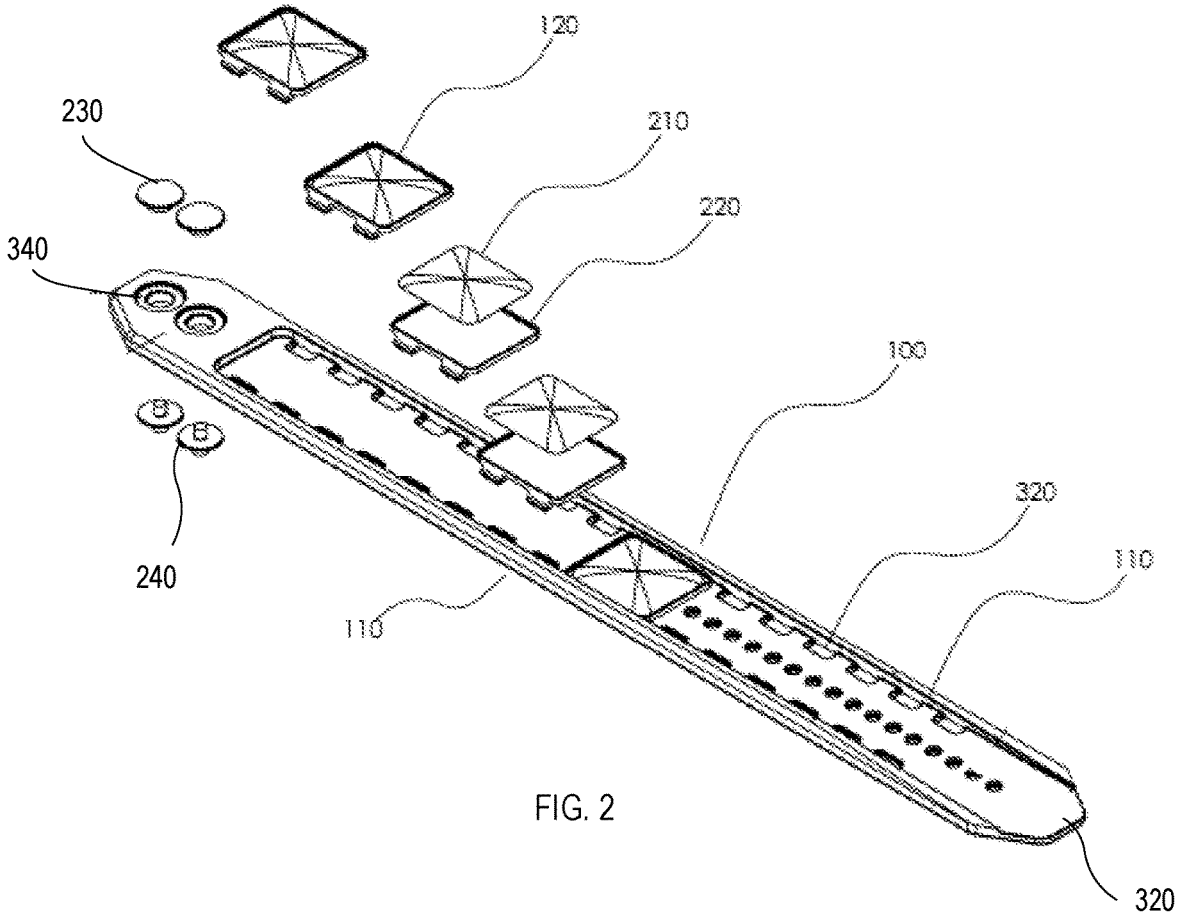
FIG. 2 is an exploded view of the wearable product of FIG. 1, in embodiments.

FIG. 1 is a perspective view of a wearable product with detachable tag assemblies. FIG. 2 is an exploded view of FIG. 1 and FIGS. 3A-3E are more detailed views of the mounting track of FIG. 1, in embodiments. FIGS. 1, 2 and 3A-3E are best viewed together in the following discussion.

FIG. 1 shows wearable product 100 including mounting track 110 and detachable tag assemblies 120. More or fewer detachable tag assemblies 120 may be secured to mounting track 110. In the illustrative embodiment of FIG. 1, at least one detachable tag assembly 120 is attached to mounting track 110 utilizing latch aperture 320. In the preferred embodiment, a plurality of detachable tag assemblies 120 may be attached adjacent to one another on the mounting track 110. More or fewer detachable tag assemblies 120 than those shown in FIG. 1 may be secured to mounting track 110.

In an embodiment, mounting track 110 is a silicone band that can be worn around a user's wrist, although other mounting track materials and embodiments are contemplated. Mounting track 110 may also be incorporated into other articles such as hats, shoes, belts, shirts, coats, outerwear, cellular telephone cases, backpacks, bags, dog collars, and other similar articles, which may be understood as either wearable or not wearable. Mounting track 110 has an outer surface 300 and an inner surface 350, which have an overall width W and length L. In embodiments, width W may be approximately 0.25 to 6 inches and length L may be 1 to 24 inches, although other sized are contemplated. A wearable product as disclosed herein may include more than one mounting track. Mounting track 110 also has an overall thickness T, which may be approximately one inch or less. A recessed tag channel 310 is integrally formed in outer surface 300. A plurality of latch apertures 320 for securing detachable tag assembly 120 to mounting track 110 are spaced along recessed tag channel 310. Recessed tag channel 310 has the advantage of keeping the detachable tag assembly 120 from protruding beyond the outer surface 300 of the mounting track 110 and being exposed to physical damage and provides a more streamlined appearance. Latch apertures 320 may be understood as a first attachment component that cooperates with a second attachment component of a detachable tag assembly.

FIG. 2 is an exploded view of the wearable product of FIG. 1. As least one detachable tag assembly 120 is mounted to a mounting track 110 using latch aperture 320. The mounting track 110 contains a plurality of latch apertures 320 which receive a corresponding second attachment component of detachable tag assembly 120 as described in more detail in connection with FIGS. 4A-4D. Detachable tag assemblies 120 are shown as having a customizable mateable accessory 210 that is secured to tag base 220 through the use of adhesive, magnets, Velcro®, 3M Dual Lock®, or other suitable methods. In embodiments, detachable tab assembly 120 may be formed from a single piece of material, and patterns or shapes may be formed in an outer surface of the tag assembly.

Recessed tag channel 310 also includes a plurality of snap apertures 330 at the one end that can be used to secure mounting track 110 around the user's wrist, in embodiments. Alternatively, the plurality of snap apertures 330 may not be utilized in embodiments where the mounting track 110 is secured to a device or product through other means. For example, the mounting track 110 could be sewn into a shoe, shirt, coat, hat, belt, or other article of clothing. Likewise, the mounting track 110 could be integrally molded into an article such as the case for a cellular phone. Further, mounting track 110 may be secured to an article using adhesive.

FIG. 2 also illustrates an outer snap 230 inserted into the recessed counterbore 360 on the outer surface 300 of the mounting track 110 and an inner snap 240 inserted into the recessed counterbore 365 on the inner surface 350 of the mounting track 110. The inner snap 240 and outer snap 230 can be mated through any one of the plurality of snap apertures 330 in the recessed tag channel 310 to secure the mounting track 110 to a user's wrist.

Figure 3A:
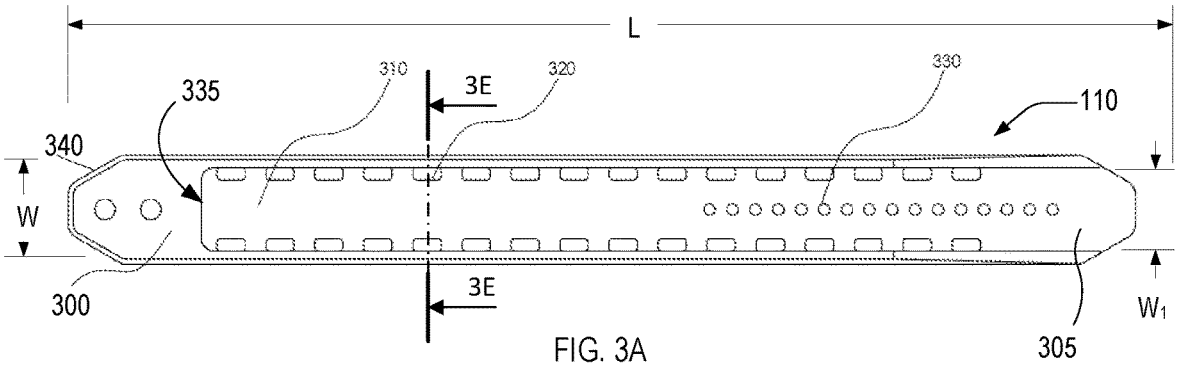
FIG. 3A is a top view of a mounting track of the wearable product of FIG. 1, in embodiments.

FIG. 3A is a top view of a mounting track of FIG. 1, in embodiments. Mounting track 110 has a length L and width Was described above. Recessed tag channel 310 is formed in outer surface 300. As shown, recessed tag channel 310 is open at end 305 of mounting track 110 and extends along a length of mounting track 110 less than length L to closed end 335. In embodiments, both ends of recessed tag channel 310 may be closed and recessed tag channel 310 may have any length as long as it allows for securing at least one detachable tag assembly 120. Recessed tag channel 310 contains latch apertures 320 and the snap apertures 330. Recessed tag channel 310 is recessed from the outer surface 300 of the mounting track 110 in a manner such that the detachable tag assemblies 120 are nearly flush with the outer surface 300 of the mounting track 110. Recessed tag channel 310 has depth from outer surface 300 referred to as thickness $T_1$ such that $T_1<T$.

The outer surface 300 of the end 340 of mounting track 110 also contains at least one outer counterbore 360 for receiving the outer snap 230. As depicted, two outer counterbores 360 and 370 for receiving two outer snaps 230 are provided but any number of counterbores may be included. The ends of the mounting track 110 are angled in the preferred embodiment, but could be rounded, square, or otherwise shaped.

Figure 3B:
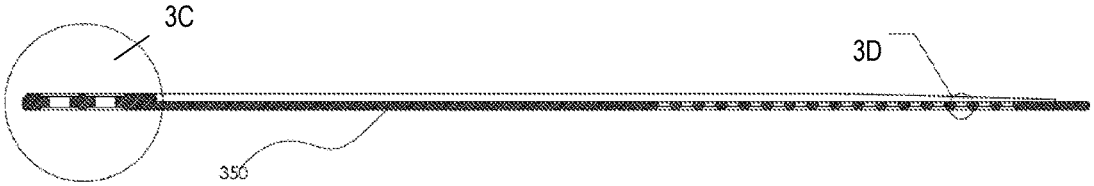
FIG. 3B is a front elevation view of the mounting track of FIG. 3A.

FIG. 3B illustrates a front elevation view of the mounting track 110. Tapered end 340 of the mounting track 110 allows for the overlap of the mounting track 110 without resulting in a band of unacceptable thickness of the invention when worn around the user's wrist. Tapered ends 305 and 340 may not be included in embodiments where the mounting track 110 is utilized in applications such as hats, shoes, belts, shirts, coats, outerwear, cellular telephone cases, and other similar articles. Ends 305 and 340 may be tapered along the width W of mounting track 110, the thickness T, or both.

Figure 3C:
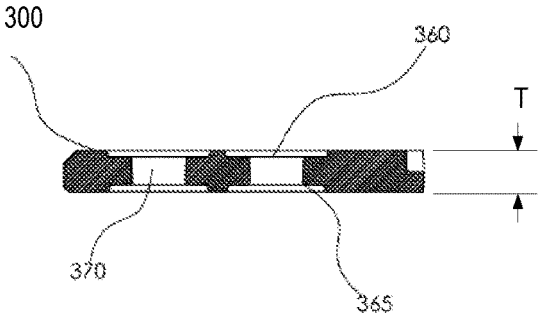
FIG. 3C is a more detailed view of a portion of FIG. 3B showing snaps for use with the mounting track of FIG. 3A.

FIG. 3C illustrates the outer snap 230 and inner snap 240 in greater detail. Outer snap 230 comprises outer snap counterbore 360 and receiving snap aperture 370 such that outer snap 230 is flush with the outer surface 300 of the mounting track 110. Likewise, the inner snap 240 comprises inner snap counterbore 365 and receiving snap aperture 370 such that inner snap 240 is flush the inner surface 350 of the mounting track 110.

Figure 3D:
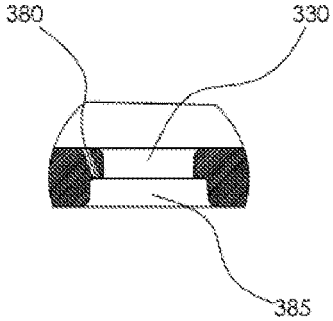
FIG. 3D is a more detailed view of a portion of FIG. 3B showing apertures in the mounting track of FIG. 3A.

FIG. 3D illustrates the snap aperture 330 in greater detail. The snap aperture 330 is located in the recessed tag channel 310. The snap aperture 330 is appropriately sized for the mating of outer snap 230 and inner snap 240 to ensure a tight, secure fit when the mounting track 110 is worn about the user's wrist. A snap recess 385 is located on the inner surface 350 of the mounting track 110. A snap shoulder 380 located within the snap recess 385 is utilized so that the inner snap 240 contacts the snap shoulder 380 instead of the inner surface 350 of the mounting track 110.

Figure 3E:
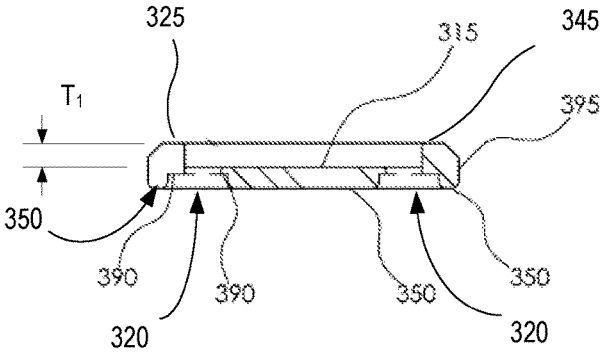
FIG. 3E is a cross section view of the mounting track of FIG. 3A.

FIG. 3E is a cross section view along lines 3E-3E of FIG. 3A depicting the recessed tag channel 310 and the recessed latch apertures 320. The recessed tag channel 310 includes a tag landing surface 315 bordered by a first tag channel wall 325 and a second tag channel wall 345 along its length. Tag landing surface 315 is at the base of the recessed tag channel 310 and is designed such that the detachable tag assemblies 120 are recessed from, and do not protrude above outer surface 300 of the mounting track 110. In embodiments, recessed tag channel 310 may have any thickness $T_1$ that maintains the structural integrity of mounting track 110 and detachable tag assemblies may be completely recessed from outer surface 300 or may protrude above outer surface 300. On either side of the tag landing surface 315 is a latch aperture 320 for detachably mounting the detachable tag assemblies 120 to the mounting track 110. In embodiments, latch apertures 320 extend from tag landing surface 315 to inner surface 350. In further embodiments, a single latch aperture 320 for each detachable tag assembly 120 could be located in the tag landing surface 315.

Latch apertures 320 on the inner surface 350 of the mounting track 110 comprise a recessed latch shoulder 390 such that the latch 460 (FIG. 4C) of detachable tag assembly 120 does not contact the inner surface 350 of the mounting track 110. In an alternative embodiment of the invention, the mateable accessory 210 could be affixed directly to the tag landing surface 315 in the recessed tag channel 310 of the mounting track 110 utilizing adhesive, magnets, Velcro, 3M Dual Lock, or other suitable methods and without using a tag base 220.

Figure 4A:
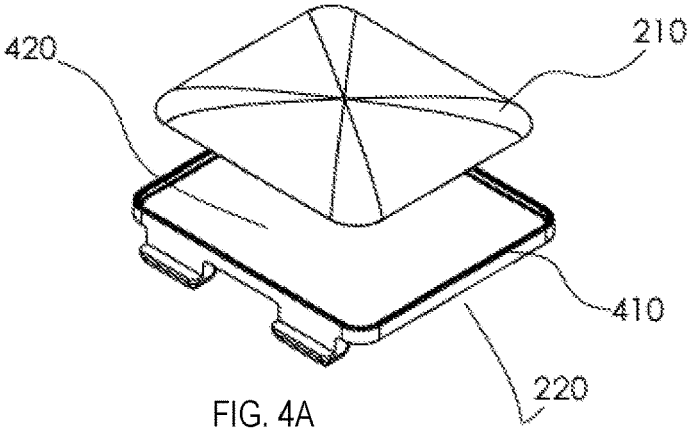
FIG. 4A is an exploded view of a detachable tag assembly of FIG. 1, in embodiments.

FIGS. 4A-4D illustrate detachable tag assembly 120 in greater detail. FIG. 4A depicts customizable mateable accessory 210 and tag base 220. Customizable mateable accessory 210 is secured to tag mating surface 400 of the tag base 220 through the use of a suitable adhesive, magnet, Velcro, 3M Dual Lock, for example. In an embodiment, the customizable mateable accessory 210 may be a custom domed label available from DomeTag® in Salt Lake City, Utah. Alternatively, the customizable mateable accessory 210 could be any kind of label, etched metal, molded plastic, cast metal, or suitable material for use as an accessory. The customizable mateable accessory 210 could depict any activity or interest of the user including sports, family, politics, religion, health, social issues, artistic designs, or as designed and selected by the wearer. As depicted in FIG. 4A, the tag mating surface 400 is surrounded by a tag frame 410 to aid in mounting the customizable mateable accessory 210 and to protect the customizable mateable accessory 210 from becoming accidentally damaged, loosened, or inadvertently removed from the tag base 220. In embodiments, a center region of the tag base 220 is made of a material and thickness to form a tag flexible region 420. The tag flexible region 420 is beneficial in that it allows the detachable tag assembly 120 to deform to the shape of the wrist of the user or other article to which it is detachably affixed. In further embodiments, some or all of tag base 220 is made of a flexible material, for example, silicone or another polymer.

In embodiments, an RFID tag may be mounted to the tag mating surface 400 of the tag base 220 instead of or in addition to customizable mateable assembly 210. An RFID tag may be utilized to transmit and receive information such as location, speed, velocity, contactless payment, and timing of sporting events such as runs, cross country races, triathlons, bike races, etc. When including an RFID tag, detachable tag assembly 120 may then be detachably mounted in recessed tag channel 310 of mounting track 110 and used to track the location of people such as doctors and patients at a hospital. It may also be used to time sporting events such as competitor's times in a race, or used for contactless payment at a concert, convention, or sporting event. This is advantageous in that the RFID detachable tag assembly 120 would only need to be mounted to the mounting track 110 for the duration of the event and could then be replaced with a different detachable tag assembly.

Figure 4B:
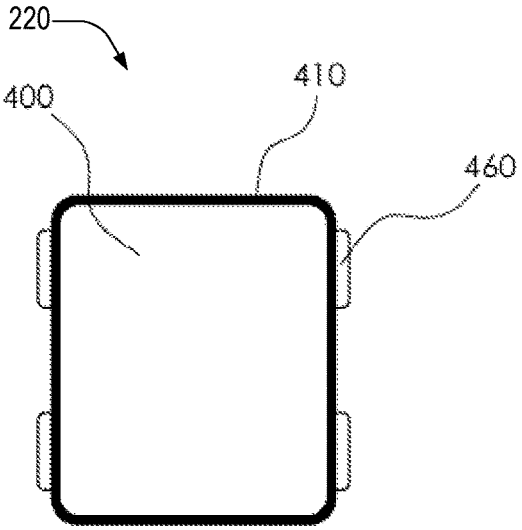
FIG. 4B is a top view of a tag base of the detachable tag assembly of FIG. 4A.

FIG. 4B is a top view of the tag base 220 without a customizable mateable accessory 210. Tag frame 410 surrounds the mating surface 400. Four latches 460 of the tag base 220 are located on two opposite sides of tag base 220 and are used to secure the detachable tag assembly 120 to the mounting track 110.

Figure 4C:
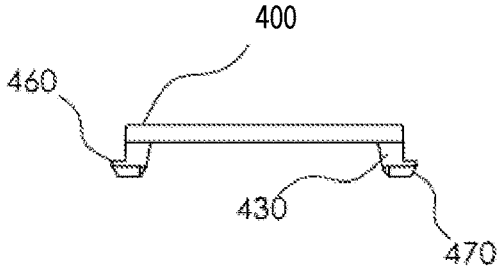
FIG. 4C is a front elevation view of the tag base of the detachable tag assembly of FIG. 4A.
Figure 4D:
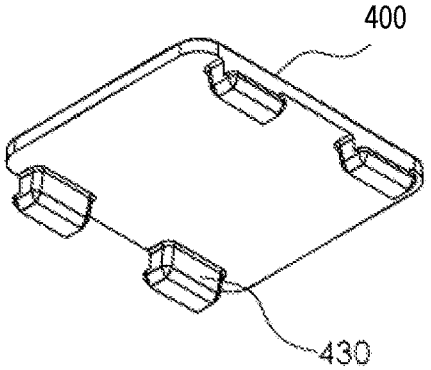
FIG. 4D is a perspective bottom view of the tag base of the detachable tag assembly of FIG. 4A.

FIG. 4C is a front elevation view of tag base 220. Tag base 220 is detachably secured to mounting track 110 through the combination of tag legs 430, tag latch 460, and tag lead-in 470. Tag lead-in 470 is a beveled edge that make it easier to insert the detachable tag assembly 120 through the latch aperture 320 and secure it to the mounting track 110. Tag latch 460 is a contact point for securing the detachable tag assembly 120 to the recessed latch shoulder 390 of the mounting track 110. Tag leg 430 connects the tag latch 460 and tag lead-in 470 to the tag base 220. FIG. 4D is a perspective bottom view of tag base 220. Although a specific design is shown in FIGS. 4A-4D, this is to illustrate principles discussed herein and different designs are contemplated. For example, tag legs 430 may be longer or shorter than depicted or tag latches 460 may point towards the center of tag base 220 instead of away from the center.

Figure 5:
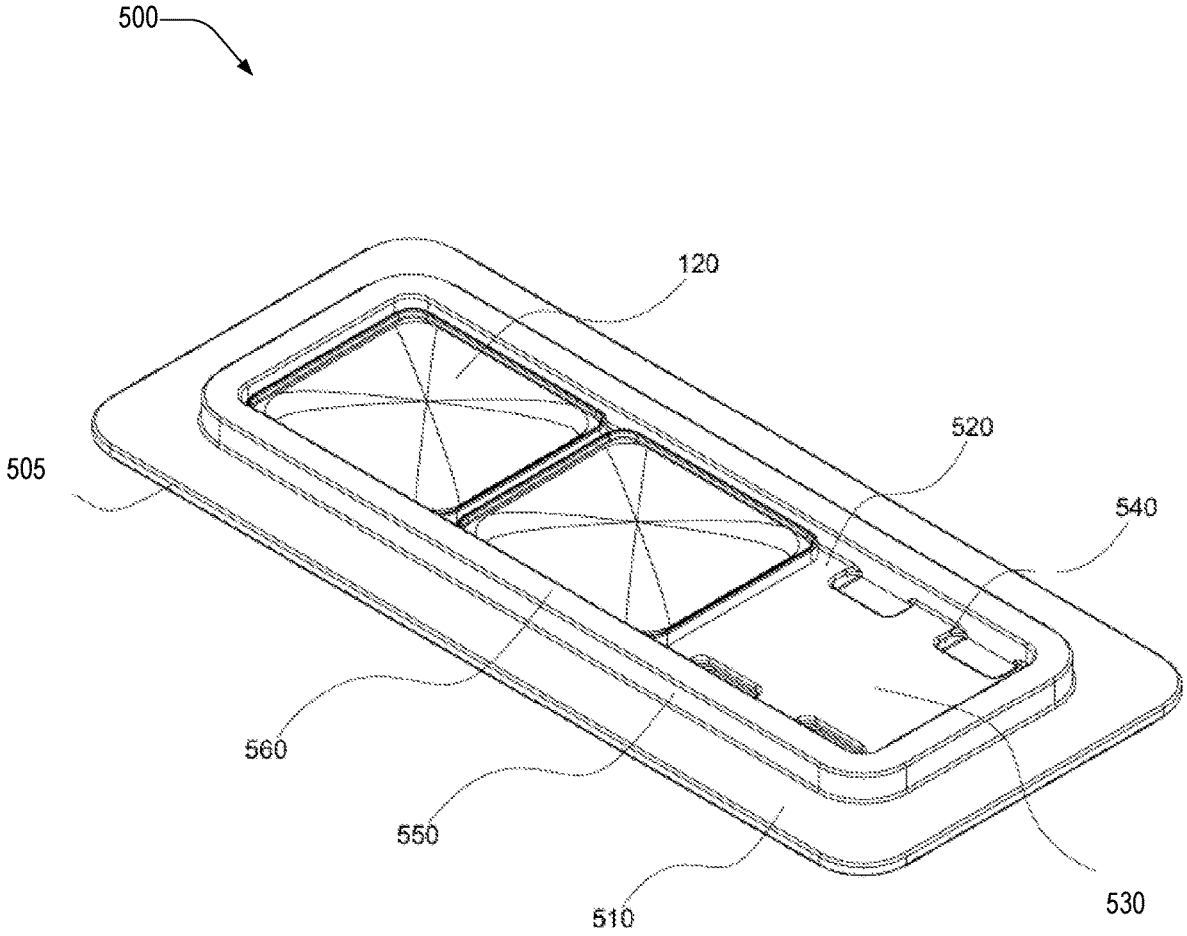
FIG. 5 illustrates the wearable product of FIG. 1 with a mounting flange, in embodiments.

FIG. 5 illustrates the wearable product 500 with a mounting flange. Wearable product 500 is an example of wearable product 100 with modifications as described below. Mounting track 505 includes a recessed tag channel 520 with a plurality of latch apertures 540 and a tag channel wall 550. Detachable tag assemblies 120 are retained in recessed tag channel 520 using latch apertures 540 as described above. Wearable product 500 also includes mounting flange 510. Wearable product 500 may be sewn, glued, affixed with hook and loop tape, or other known securement methods onto an article such as a hat, shirt, belt, shoe, shirt, outerwear or other article of clothing using mounting flange 510. It may also be secured to devices such as a cell phone case or laptop. Wearable product 500 of FIG. 5 does not use snap apertures 330 since it is affixed to the article using the mounting flange 510. The detachable tag assemblies 120 are the same as described in FIG. 4A-4D above and are detachably mounted to the mounting track 505 in the same manner. The upper edge of the tag channel wall 550 is the outer surface 560 of the mounting track 505. In embodiments, mounting flange 510 may be larger or smaller than depicted in FIG. 5, and may include holes or other structures for securing wearable product 500 to clothing or a personal accessory.

Figure 6A:
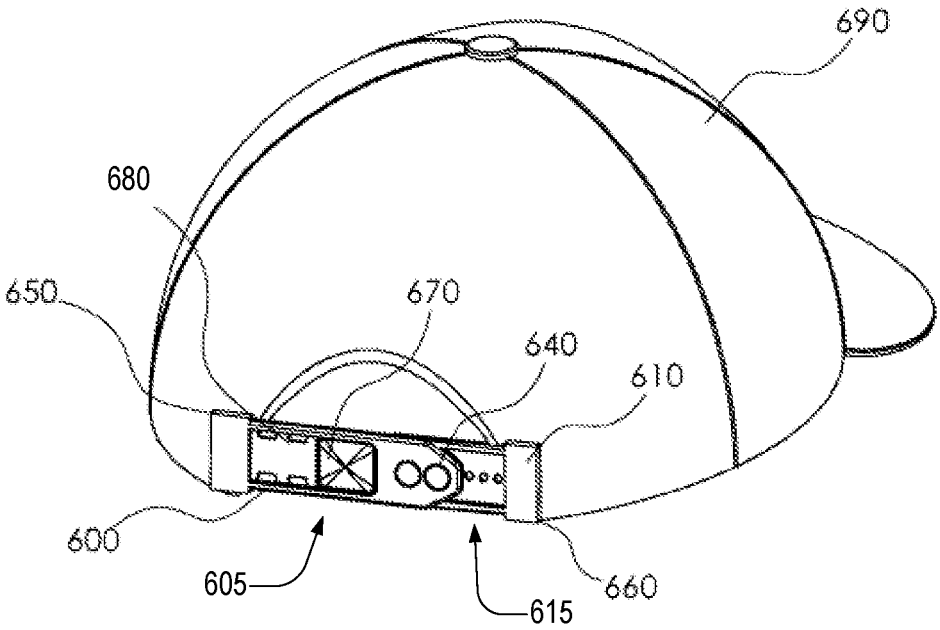
FIG. 6A is a perspective view of the mounting track of FIG. 1 secured to a hat, in embodiments.

FIG. 6A illustrates a mounting track 600 secured to a hat 690. In embodiments, mounting track 600 is an example of mounting track 110 with modifications as described below. A first portion 605 of mounting track 600 is sewn into hat 690 at the left of a rear opening and a second portion 615 of mounting track 610 is sewn into the hat at the right of the rear opening in lieu of a traditional snap back closure. At least one outer snap 640 on first portion 605 is secured to a snap aperture 645 on second portion 615 to create an appropriate fit for hat 690. In this embodiment, detachable tag assemblies 670, which are an example of detachable tag assemblies 120, are secured to first portion 605 using latch aperture 680 of recessed tag channel 620, although detachable tag assemblies 670 may also be attached to the second portion 615 as well, or to both portions.

Figure 6B:
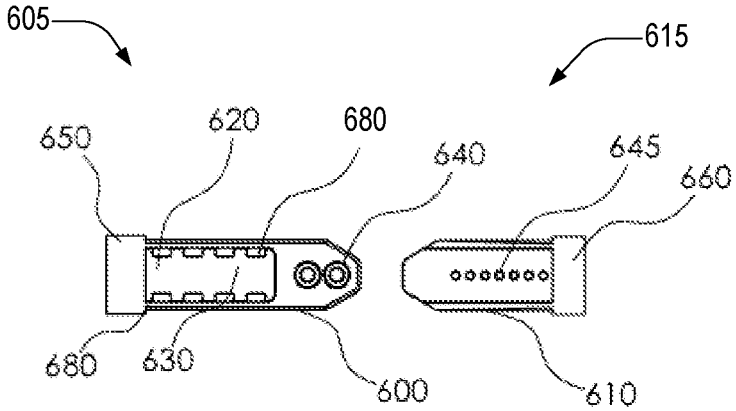
FIG. 6B is an expanded view of mounting track 600 of FIG. 6A.

FIG. 6B is an expanded view of mounting track 600 of FIG. 6A. First portion 605 has a mounting flange 650 at an end of the recessed tag channel 620 such that the mounting track 600 can be affixed to a hat, belt, or any article that may utilize a snap closure. As with the embodiment of the recessed tag channel described in FIG. 3A-3E above, the recessed tag channel 620 has a plurality of latch apertures 680, a tag landing surface 630, a track channel wall 680, a snap aperture 645, and an outer snap 640. The inner surface (not shown) of first portion 605 comprises a plurality of latch apertures 680. Second portion 615 also has a mounting flange 660 at an end of second portion 615 such that it can be affixed to an article such as a hat, belt, or any article that may utilize a snap closure. Second portion 615 has a plurality of snap apertures 645 which may receive the outer snap 640 of the first portion of the mounting track 600. The detachable tag assemblies 670 are the same as described in FIG. 4A-4C above and are detachably mounted to the mounting track 600 and 610 in the same manner.

Figure 7:
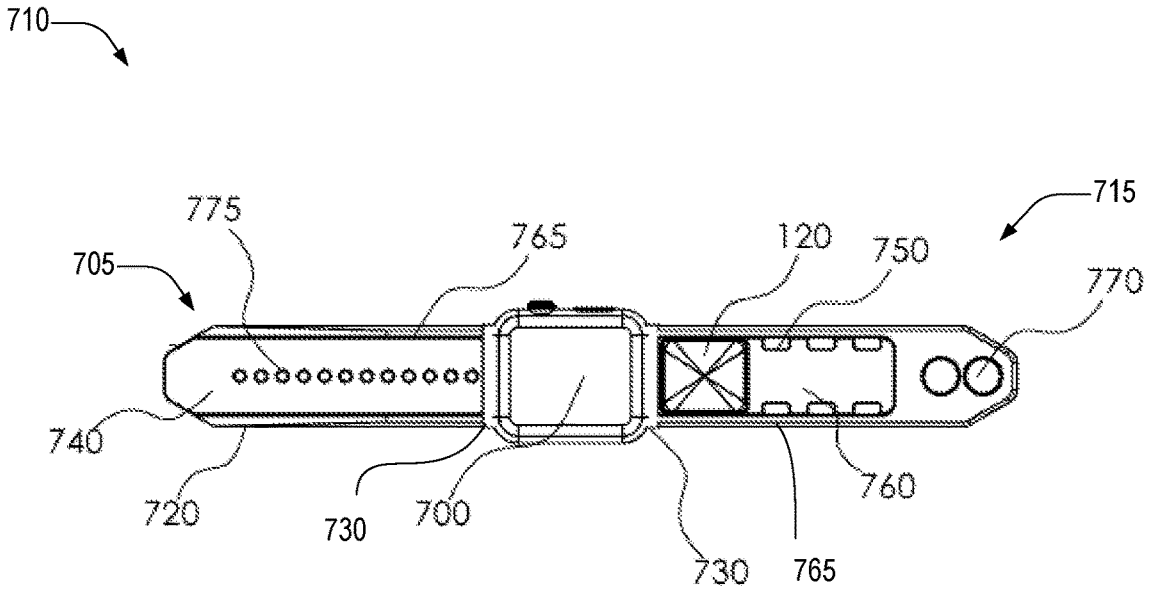
FIG. 7 illustrates the mounting track of FIG. 1 incorporated into a watch band, in embodiments.

FIG. 7 illustrates mounting track 710 incorporated into a watch band, in embodiments. In this embodiment, mounting track 710is separated into first portion705 and second portion 715, and replaces a watchband in a product such as the Apple iWatch® 700. Mounting track 710 has a mounting flange 730 at one end which includes an aperture compatible with a spring-bar assembly typically used in watches or compatible with the watch band slot on the Apple iWatch 38 mm, 40 mm, 42 mm, and 44 mm iWatch cases. As with the embodiment of the recessed tag channel described in FIG. 3A-3E above, first portion 705 includes recessed tag channel 740 with a tag channel wall 720 and snap apertures 775. Second portion 715 also has a mounting flange 730 at one end, mounting flange 730 including an aperture and pin assembly necessary to secure second portion 715 to watch bezel 700. Second portion 715 has a recessed tag channel 740 with a plurality of latch apertures 750, a tag landing surface 760, and a track channel wall 765. Detachable tag assemblies 120 are detachably mounted to the second portion of the mounting track 720 as described above in connection with FIGS. 3!-3E and 4A-4D.

Figure 8A:
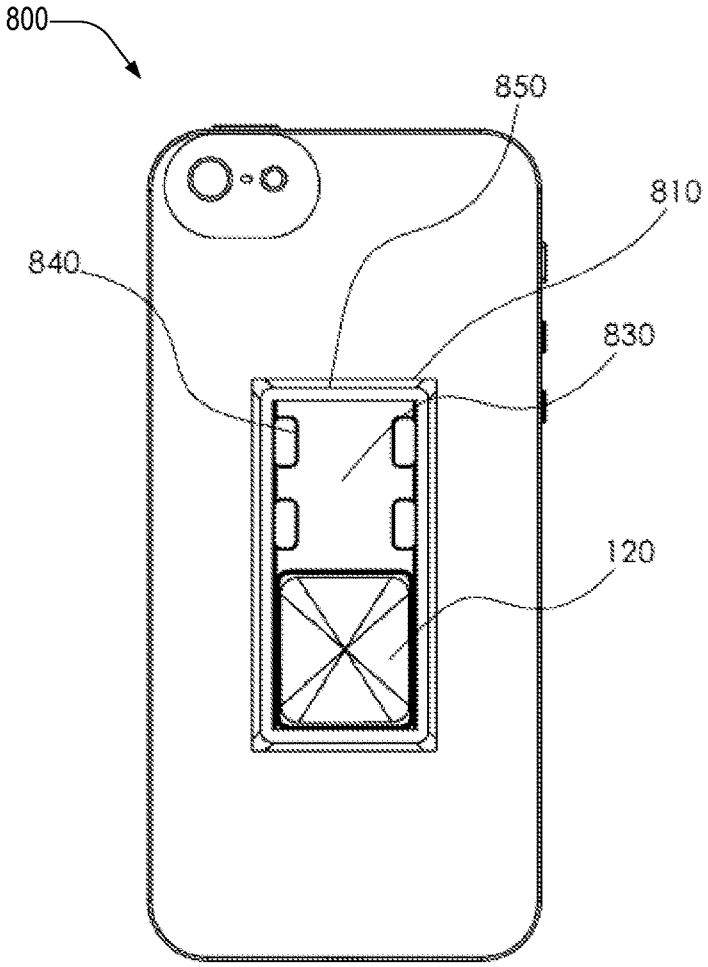
FIGS. 8A and 8B illustrate the mounting track of FIG. 1 incorporated into the protective case for a cellular telephone, in embodiments.
Figure 8B:
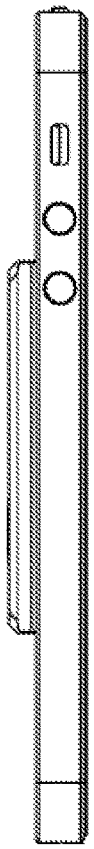

FIGS. 8A and 8B illustrate mounting track 810 incorporated into the protective case 800 for cellular telephone. FIG. 8A is a back view of case 800 and FIG. 8B is a side view of case 800. In an embodiment, mounting track 810 is affixed to protective case 800 with an adhesive. Alternatively, mounting track 810 is integrally molded into cellular telephone case 800. Mounting track 810 comprises a recessed tag channel 820, a tag landing surface 830, a track channel wall 850, and a plurality of latch apertures 840 for receiving the detachable tag assemblies 120. The detachable tag assemblies 120 are detachably mounted to the mounting track 810 as described in FIGS. 4A-4C above.

Figure 9A:
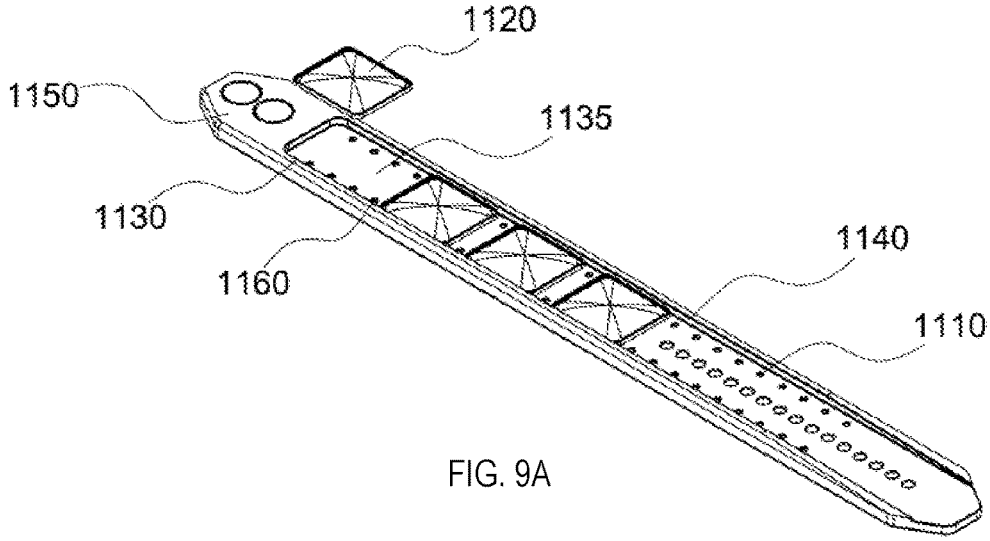
FIGS. 9A-9C illustrate the wearable product of FIG. 1 using a ball and socket system for securing detachable tag assemblies, in embodiments.
Figure 9B:
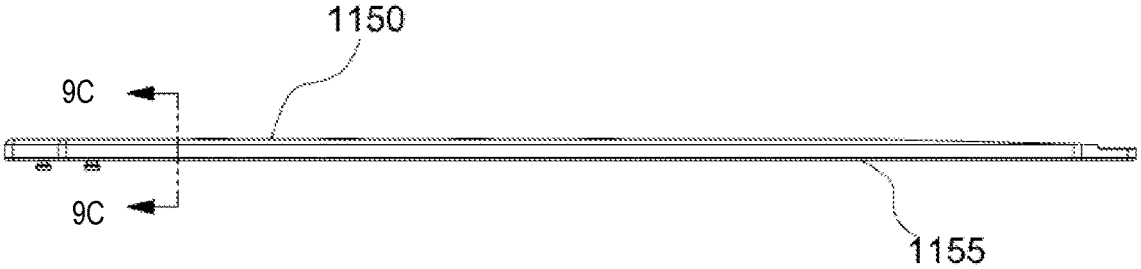
Figure 9C:
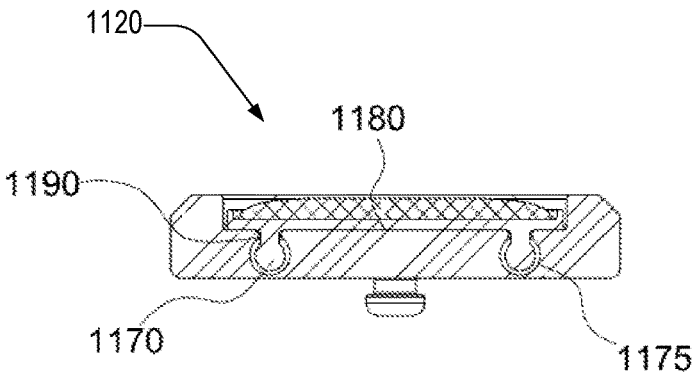

FIG. 9A is a perspective view of an example of the wearable product of FIG. 1 using a ball and socket system for securing detachable tag assemblies. FIG. 9B is a side elevation view and FIG. 9C is a cross-sectional view along line 9C-9C of FIG. 9B. In an embodiment, detachable tag assembly 1120 is secured to the mounting track 1110 using a ball and socket system. FIG. 9A illustrates mounting track 1110 comprising a recessed tag channel 1130, a tag channel wall 1140, a tag landing surface 1135 and a plurality of socket apertures 1160 and sockets 1175 for receiving a plurality of balls 1170 of detachable tag assembly 1120. The plurality of socket apertures 1160 are positioned in the recessed tag channel 1130 such that they provide an opening for the ball 1170 of the detachable tag assembly 1120 to be inserted through the socket aperture 1160 so that ball 1170 can properly mate with the recessed socket 1175.

Additionally, the recessed tag channel 1130 and the plurality of recessed sockets 1170 are sized and shaped such that the detachable tag assembly 1120 is nearly flush with the outer surface 1150 of the mounting track 1110. FIG. 9B a side view of mounting track 1110. FIG. 9C is a cross section view of the mounting track 1110 of FIG. 9B along line 9C-9C in which a detachable tag assembly 1120 has been inserted into the recessed socket 1175 through the socket apertures 1160 in the mounting track 1110. Ball 1170 on tag base 1180 of the detachable tag assembly 1120 is positioned at the distal end of the tag leg 1190 such that the detachable tag assembly 1120 can properly mate with the recessed socket 1175 in the recessed tag channel 1130 of the mounting track 1110. The recessed socket 1175 in in the mounting track 1110 and does not extend through the mounting track 1110 to its inner surface 1155. Embodiments shown in FIGS. 9A-9C may be incorporated in any of the mounting tracks and wearable products disclosed herein.

FIG. 10A-10D illustrates wearable product 1300 using a tongue and groove system for securing a detachable tag assembly. FIGS. 11A-11B show of a detachable tag assembly for use in the wearable product 1300 of FIGS. 10A-10D. FIGS. 10A-10D and 11A-11B are best viewed together in the following description.

Figure 10A:
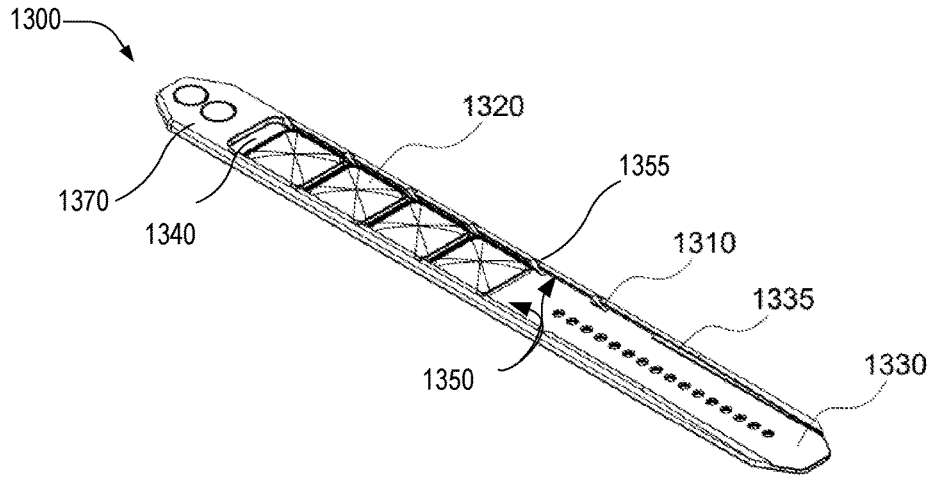
FIG. 10A-10D illustrate the wearable product of FIG. 1 using a tongue and groove system for securing a detachable tag assembly, in embodiments.
Figure 10B:
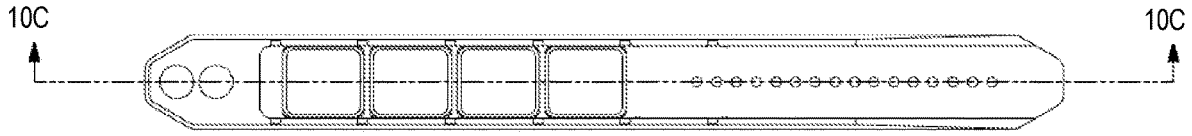
Figure 10C:
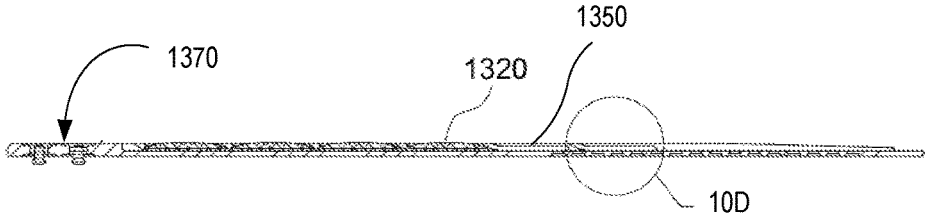
Figure 10D:
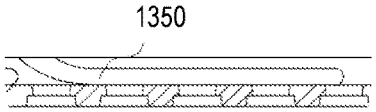
Figure 11A:
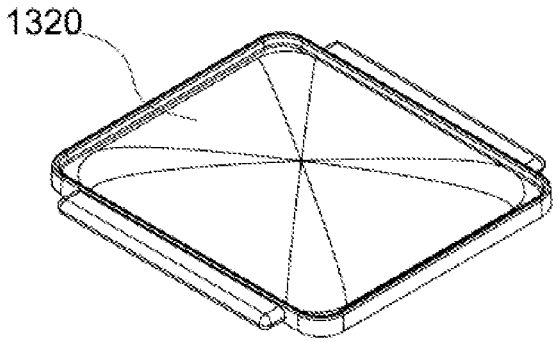
FIG. 11A is a perspective view of a detachable tag assembly for use in the wearable product of FIGS. 10A-10D, in embodiments.
Figure 11B:
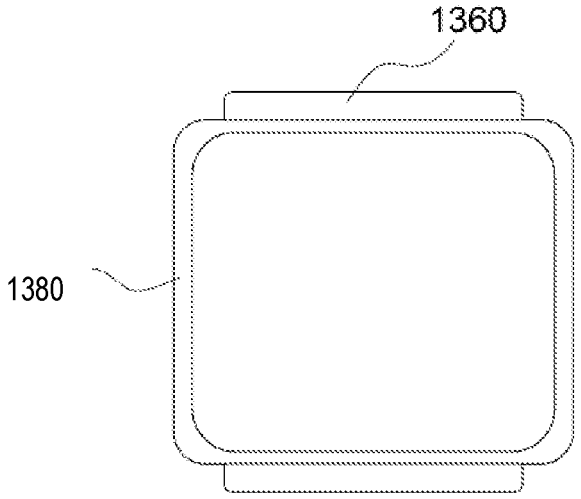
FIG. 11B is a top view of the detachable tag assembly of FIG. 11A.

FIG. 10A is a perspective view of wearable product 1300 comprising a recessed tag channel 1330, a channel wall 1335, a tag landing surface 1340, and sets of corresponding grooves 1350 in the opposing longitudinal tag channel walls 1345. The plurality of corresponding grooves 1350 in the opposing longitudinal tag channel walls 1345 are sized to receive tongue 1360 of the detachable tag assembly 1320 and to secure detachable tag assembly 1320 to the mounting track 1310 after passing track stop 1355 in longitudinal tag channel walls 1345. The corresponding grooves 1350 and the depth of the recessed tag channel 1330 are designed to keep the detachable tag assembly 1320 nearly flush with the outer surface 1370 of the mounting track 1310. FIG. 10B is a top view of wearable product 1300 and FIG. 10C is a cross sectional view of FIG. 10A along lines 10C-10C. FIG. 10D is a more detailed view of groove 1350. Elements not specifically identified in FIGS. 10A-10D are similar to like elements discussed above. Embodiments for securing a detachable tag assembly to a mounting track shown in FIGS. 10A-10D may be incorporated in any of the mounting tracks and wearable products disclosed herein.

FIG. 11A is a perspective view of detachable tag assembly 1320 for use with wearable product 1300 of FIGS. 10A-10D. FIG. 11B is a top view of detachable tag assembly 1320. Detachable tag assembly 1320 includes a tongue 1360 opposing sides of the tag frame 1380. Tongue 1360 mates with the corresponding grooves 1350 in longitudinal tag channel walls 1345.

Figure 12A:
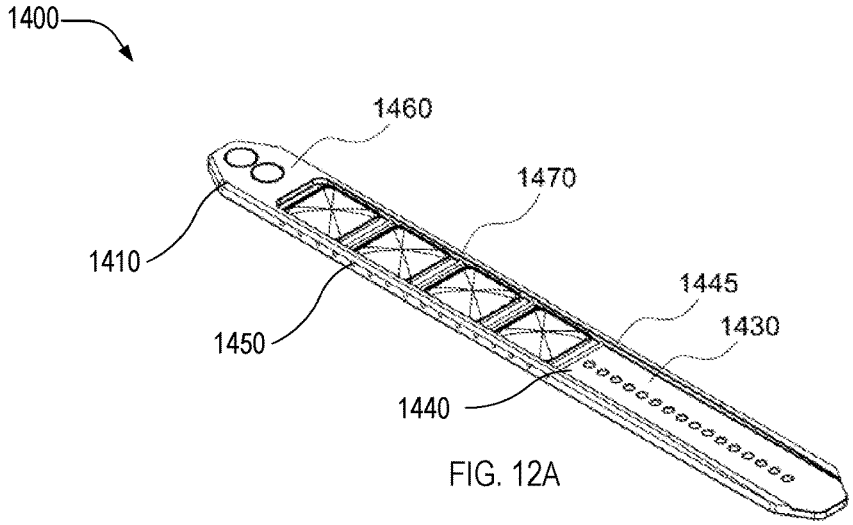
FIGS. 12A-12D illustrate the wearable product of FIG. 1 using a peg system for securing the detachable tag assembly, in embodiments.
Figure 12B:
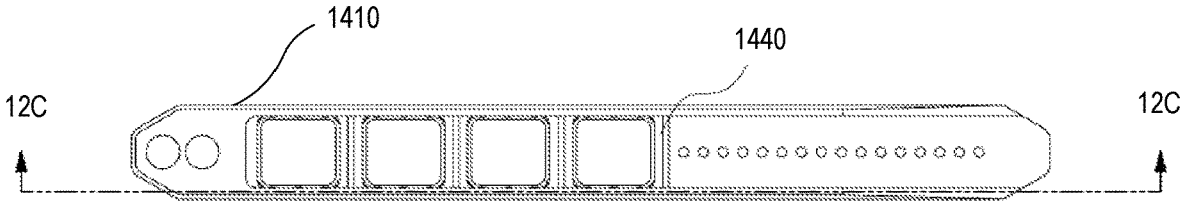
Figure 12C:
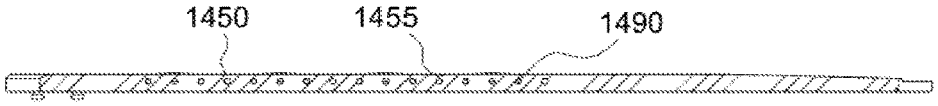
Figure 12D:
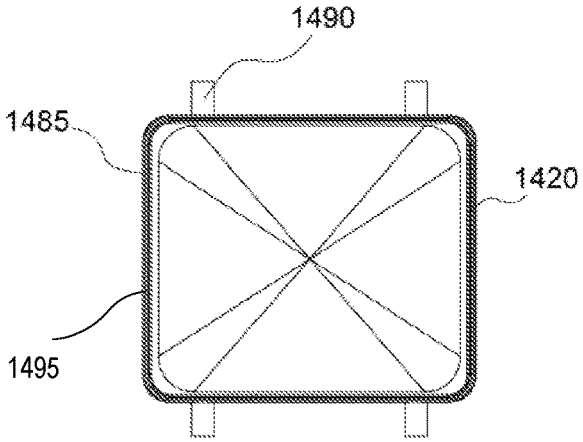

FIGS. 12A-12D illustrate wearable product 1400 using a peg locking system for securing the detachable tag assembly to a mounting track. FIG. 12A is a perspective view of wearable product 1400. FIG. 12B is a top view of wearable product 1400 and FIG. 12C is a cross sectional view of FIG. 12B along lines 12C-12C. FIG. 12D is a top view of detachable tag assembly 1420. Elements not specifically identified in FIGS. 12A-12D are similar to like elements discussed above.

Wearable product 1400 includes mounting track 1410 which includes a plurality of peg apertures 1450 in opposing tag channel walls 1445 of the recessed tag channel 1430. Peg apertures 1450 include an inner peg lock aperture 1455 that is smaller than the peg aperture 1450. Peg apertures 1450 are sized and positioned on opposing tag channel walls 1445 of the recessed tag channel 1430 such that the detachable tag assemblies 1420 contact the tag landing surface 1440 and are nearly flush with the outer surface 1460 of the mounting track 1410 when mated with the mounting track 1410. A plurality of detachable tag assemblies 1420 may be mated with the mounting track 1410 using the peg locking system.

Tag frame 1495 comprising tag pegs 1490 on opposing sides of the tag base 1485. The tag pegs 1490 are designed to be inserted into peg apertures 1450 in tag channel wall 1445 of the recessed tag channel 1430 of the mounting track 1410. Embodiments shown in FIGS. 12A-12D may be incorporated in any of the mounting tracks and wearable products disclosed herein.

As one of skill in the art will appreciate, there are numerous variations and substitutions that may be made in the invention, its use and configuration to achieve substantially the same results as achieved by the embodiments described herein. For example, other mechanisms for securing detachable tag assemblies to a mounting track may be provided, such hook and loop tape.

In a further embodiment, detachable tag assemblies may also be secured to a mounting track using a flexible magnetic system. In this system, a recessed tag channel may include a ferromagnetic tag landing surface that has been plated or coated with a flexible ferromagnetic material. The underside of the tag base of a detachable tag assembly may be a planar surface which has been coated with a ferromagnetic material that will mate with the flexible ferromagnetic material of the tag landing surface in the recessed tag channel. A sufficient amount of ferromagnetic material is used in the planar surface of the tag base and the landing surface of the recessed tag channel is provided such that the detachable tag assembly 130 cannot be inadvertently loosened from the mounting track.

Accordingly, there is no intention to limit the invention to the disclosed exemplary forms. Many variations, modifications, and alternatives constructions fall within the scope and spirit of the disclosed inventions as expressed in the claims.

What is claimed is:

1. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$, a length $L_1<L$, and a thickness $T_1<T$, the recessed tag channel comprising:

a tag landing surface having width $W_1$and a length $L_1$;

a first tag channel wall formed along a first side of the tag landing surface; and a second tag channel wall formed along a second side of the tag landing surface across width $W_1$, wherein the first tag channel wall and the second tag channel wall have a thickness T; and a first attachment component in the recessed tag channel, the first attachment component comprising:

a plurality of first tag apertures in the tag landing surface adjacent to the first tag channel wall along length $L_1$; and a plurality of second tag apertures in the tag landing surface adjacent to the second tag channel wall along length $L_1$, the second tag apertures aligned with the first tag apertures across width $W_1$; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base and extending around of the tag base;

a tag mounting surface on the tag base inside the tag frame; and a mateable accessory attached to the tag mounting surface.

2. The wearable product of claim 1, wherein the first and second tag apertures further comprise a plurality of recessed latch shoulders in the inner surface of the mounting track.

3. The wearable product of claim 2, wherein the second attachment component further comprises:

at least one tag leg attached to an inner surface of the tag base;

a tag latch attached to the tag leg for engaging with the recessed latch shoulders wherein the tag latch does not protrude beyond the inner surface of the mounting track; and a tag lead-in for securing the detachable tag assembly inside the recessed tag channel utilizing the tag apertures.

4. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$, a length $L_1<L$ and a thickness $T_1<T$, the recessed tag channel further comprising:

a tag landing surface having width Wi and a length $L_1$;

a first tag channel wall formed along a first side of the tag landing surface; and a second tag channel wall formed along a second side of the tag landing surface across width $W_1$, wherein the first tag channel wall and the second tag channel wall have a thickness T; and a first attachment component in the recessed tag channel comprising:

a plurality of first grooves in an interior surface of the first tag channel wall along length $L_1$; and a plurality of second grooves in the second tag channel wall along length $L_1$, the second grooves aligned with the first grooves across width $W_1$; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base and extending around of the tag base;

a plurality of planar surfaces extending from the tag frame, the plurality of planar surfaces sized and positioned for insertion into the first and second grooves to retain the detachable tag assembly in the recessed tag channel;

a tag mounting surface on the tag base inside the tag frame; and a mateable accessory attached to the tag mounting surface.

5. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$, a length $L_1<L$ and a thickness $T_1<T$, the recessed tag channel further comprising:

a tag landing surface having width $W_1$and a length $L_1$;

a first tag channel wall formed along a first side of the tag landing surface; and a second tag channel wall formed along a second side of the tag landing surface across width $W_1$, wherein the first tag channel wall and the second tag channel wall have a thickness T; and a first attachment component in the recessed tag channel comprising:

a plurality of first peg apertures in the first tag channel wall along length $L_1$; and a plurality of second peg apertures in the second tag channel wall along length $L_1$, the second peg apertures aligned with the first peg apertures across width $W_1$; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base and extending around of-the tag base;

a plurality of pegs extending from the tag frame, the plurality of pegs sized and positioned for insertion into the first and second peg apertures to retain the detachable tag assembly in the recessed tag channel; and a tag mounting surface on the tag base inside the tag frame; and a mateable accessory attached to the tag mounting surface.

6. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base around the tag base;

a tag mounting surface on the tag base inside the tag frame; and a mateable accessory attached to the tag mounting surface, wherein the detachable tag assembly comprises a plurality of detachable tag assemblies secured in the recessed tag channel.

7. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base around the tag base;

a tag mounting surface on the tag base inside the tag frame; and a mateable accessory attached to the tag mounting surface, wherein the mounting track includes a mounting flange for attaching the mounting track to an article of clothing or accessory.

8. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base around the tag base;

a tag mounting surface on the tag base inside the tag frame; and a mateable accessory attached to the tag mounting surface, wherein the mounting track provides a surface suitable for bonding via an adhesive layer to an article of clothing or accessory.

9. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; a detachable tag assembly comprising:

a second attachment component that cooperates with the first attachment component to secure the detachable tag assembly in the recessed tag channel; and an outer snap and an inner snap, wherein the outer surface of the mounting track comprises an outer counterbore for receiving the includes an outer snap, and the inner surface of the mounting track comprises an inner counterbore for receiving the includes an inner snap, and wherein the mounting track further comprises a plurality of snap apertures.

10. The wearable product of claim 9, wherein at least one of the outer snap and the inner snap are configured to engage with the snap apertures to retain the wearable product in a continuous loop.

11. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base around the tag base;

a tag mounting surface on the tag base inside the tag frame; and a mateable accessory attached to the tag mounting surface, wherein the first attachment component and the second attachment component comprise magnets.

12. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base around the tag base;

a tag mounting surface on the tag base inside the tag frame; and a mateable accessory attached to the tag mounting surface, wherein the first attachment component and the second attachment component comprise hook and loop tape.

13. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base around the tag base;

a tag mounting surface on the tag base inside the tag frame; and a mateable accessory attached to the tag mounting surface, wherein the mounting track and the detachable tag assembly are made from a flexible material.

14. A wearable product comprising:

a mounting track having a width W, a length L and a thickness T, comprising:

an inner surface having the width W and the length L;

an outer surface having the width W and the length L;

a recessed tag channel integrally formed in the outer surface, the recessed tag channel having a width $W_1<W$ and a thickness $T_1<T$; and a first attachment component in the recessed tag channel; and a detachable tag assembly comprising;

a second attachment component that cooperates with the first attachment component to secure the detachable tag assembly in the recessed tag channel;

a tag base having a width of approximately $W_1$;

a tag frame on an outer surface of the tag base and extending around the tag base;

a tag mounting surface on the tag base inside the tag frame; and a label attached to the tag mounting surface.

* * * * *